US009283684B2

(12) United States Patent
Brucart-Puig

(10) Patent No.: US 9,283,684 B2
(45) Date of Patent: Mar. 15, 2016

(54) CORKSCREW WITH SEMI-AUTOMATIC TELESCOPIC CAPSULE-CUTTER

(76) Inventor: Ramon Brucart-Puig, Sabadell (ES)

( * ) Notice: Subject to any disclaimer, the term of this patent is extended or adjusted under 35 U.S.C. 154(b) by 561 days.

(21) Appl. No.: 13/147,551

(22) PCT Filed: Feb. 1, 2010

(86) PCT No.: PCT/ES2010/000036

§ 371 (c)(1),
(2), (4) Date: Aug. 2, 2011

(87) PCT Pub. No.: WO2010/086478

PCT Pub. Date: Aug. 5, 2010

(65) Prior Publication Data

US 2011/0283840 A1 Nov. 24, 2011

(30) Foreign Application Priority Data

Feb. 2, 2009 (ES) ..... 200900290

(51) Int. Cl.

| | |
|---|---|
| ***B67B 7/00*** | (2006.01) |
| ***B67B 7/44*** | (2006.01) |
| ***B26B 3/06*** | (2006.01) |
| ***B26B 11/00*** | (2006.01) |
| ***B26B 5/00*** | (2006.01) |
| ***B26B 1/08*** | (2006.01) |
| ***B26B 1/10*** | (2006.01) |
| *B67B 7/04* | (2006.01) |

(52) U.S. Cl.

CPC . *B26B 11/00* (2013.01); *B26B 1/08* (2013.01); *B26B 1/10* (2013.01); *B26B 5/003* (2013.01); *B67B 7/0429* (2013.01); *B67B 2007/0458* (2013.01)

(58) Field of Classification Search

CPC .. B67B 7/04; B67B 2007/0458; B26B 5/003; B26B 1/08

USPC ..... 81/3.09, 3.35, 3.45; 30/162; 7/118, 155, 7/156

See application file for complete search history.

(56) References Cited

U.S. PATENT DOCUMENTS

| | | | | |
|---|---|---|---|---|
| 1,953,690 | A * | 4/1934 | Samways | 7/167 |
| 2,474,609 | A * | 6/1949 | Wolf | 30/162 |
| 3,906,627 | A * | 9/1975 | Manning | 30/162 |
| 6,032,553 | A * | 3/2000 | Brucart Puig et al. | 81/3.09 |
| 2012/0192434 | A1 * | 8/2012 | Syrjala | 30/162 |

* cited by examiner

*Primary Examiner* — Bryan R Muller

(74) *Attorney, Agent, or Firm* — Hoglund & Pamias, PSC; Roberto J. Rios

(57) ABSTRACT

The corkscrew according to the invention, which has the basic structure of a conventional corkscrew, comprising a helix (1) which fits into a handle (3) with a grooved configuration so that, in the operating condition of the helix (1), it may remain partially engaged within the grooved part of the handle (3), said handle (3) being hinged at one of its ends on a support arm (5), is principally characterized in that the handle (3) incorporates a metal core (7) with a basically U-shaped cross section, housing internally a longitudinally displaceable capsule-cutting knife (10) capable of protruding externally from the handle (3) and with a blade extended at the rear in the form of a widened segment (11) acting as a guide, having a lateral projection (12) protruding towards the outside of the handle (3) through a longitudinal groove (13) along which it is displaceable with the aid of the user's finger. In this way the knife may be easily extracted using only one hand.

5 Claims, 2 Drawing Sheets

CORKSCREW WITH SEMI-AUTOMATIC TELESCOPIC CAPSULE-CUTTER

FIELD OF THE INVENTION

The present invention relates to a corkscrew of the type used for opening wine bottles and the like, such as bottles closed by means of a cork.

The object of the invention is to provide a corkscrew in which the capsule-cutter blade shows an automatic retraction telescopic feature, such that said blade can easily be extracted and retracted with the aid of only one hand.

BACKGROUND OF THE INVENTION

There are many types of corkscrews with different structural and functional criteria on the market.

One of the most common and generally used solutions is a corkscrew embodied in the shape of a helix ending in a sharp tip free end for insertion into the cork and being attached by its other end in an articulated manner to a handle intended to work as a second class lever, said handle is attached also in an articulated manner at one of its ends to a support arm for said lever, specifically in a support arm on the mouth of the bottle.

This type of corkscrews are complemented with a capsule-cutting blade hinged in relation to a rotation axis, so that in a non-operating condition the blade is partially hidden within the handle so that it is not in the way nor can it cause accidental cuts during operation of the corkscrew.

Although this structure achieves its intended function, extraction of the blade is not always easy especially when the user has very short nails and cannot reach the pulling slit incorporated into this type of blades with the nails. Moreover, it is necessary to use both hands when accessing the cutting blade making impossible extracting said blade if the user has the wine bottle or the like in one hand and the corkscrew in the other.

Furthermore, the tools and assembly process used in this type of devices are complicated, increasing the price of the product.

SUMMARY OF THE INVENTION

The corkscrew according to the invention satisfactorily solves the problems set forth above in each of the aspects discussed.

To that end, more specifically and starting from the conventional structure of a corkscrew in which a helix ending in a sharp tip at one of its ends, being also attached in an articulated manner to a handle at its other end by means of a transverse pin or axis, a grooved handle for receiving the helix in a non-operating condition and having a support arm which is also articulated with respect to the handle for occupying a minimum volume when not in use, the invention being characterized by having within said handle a metal core based on a U-shaped profile or double plate having a geometric configuration according to the handle, said metal core provided with holes through which the corresponding pins or hinged pins of the helix as well as the arm acting as a lever when extracting the cork pass.

The above-mentioned metal core having a U-shaped or double-plate cross section forms in turn, a casing in which a capsule cutting-blade capable of protruding through one of its ends is slidable within and having a blade with conventional configuration either straight or slightly curved extending by its opposite end to its tip in a straight and elongated region acting as a blade guide, incorporating a lateral projection protruding outwardly through a groove positioned on the middle part of said U-shaped profile or double-plate chassis coinciding with another groove having identical proportions located on the handle such that when said lateral projection is pushed the blade slides along the metal core and thus along the handle, exiting to the outside thereof through the complementary recess. The above-mentioned blade is assisted by a spring which relates to the rear end of the metal core, such that said spring forces the blade to a retraction condition, the latter having a recess on its inner edge suitable in shape and size for engaging a pin located in the metal core, which could be the same pin used as a rotation pin for the lever arm or a pin specific for this purpose.

From the structure described and starting from the non-operating condition of the blade, the user could easily extract and retract the blade in a telescopic manner by using only one hand, so that by pressing with a finger the lateral projection of the blade protruding through the mentioned groove, the latter will be easily extracted until it is stabilized when coupled to the above-mentioned pin, allowing the capsules to be cut. For retracting, it is only necessary to push the blade with the finger on its blunt side so that it disengages from the above-mentioned pin, and by means of the effect provided by the spring, the latter is retracted into the portion of the metal core, remaining completely hidden.

BRIEF DESCRIPTION OF THE DRAWINGS

To complement the description being made herein and for aiding to better understand the features of the invention, according to a preferred practical embodiment thereof, a set of drawings is being attached as an integral part of this description in which the following has been depicted with an illustrative and non-limiting character.

DETAILED DESCRIPTION OF THE INVENTION

In view of the described drawings, it can be seen how the corkscrew according to the invention is formed, like any conventional corkscrew of this type, by a helix 1 formed by a wired element shaped as suggested by its name, ending in a sharp tip 2 at one of its ends, the helix 1 adapted into a grooved handle 3, so that in an operating condition the helix 1 remains partially engaged in the grooved portion of the handle 3.

Figure 1:
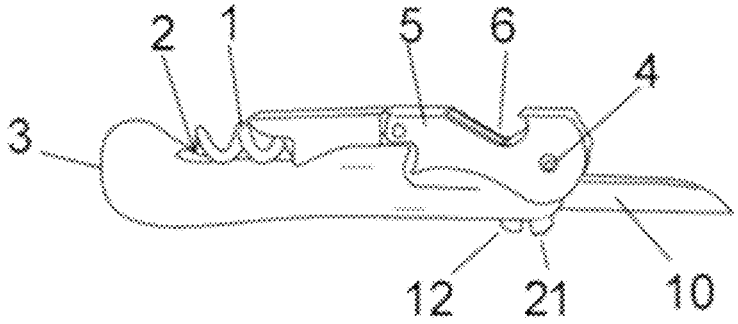
FIG. 1 shows a side elevation view of a corkscrew made according to the object of the present invention with the blade hidden.
Figure 2:
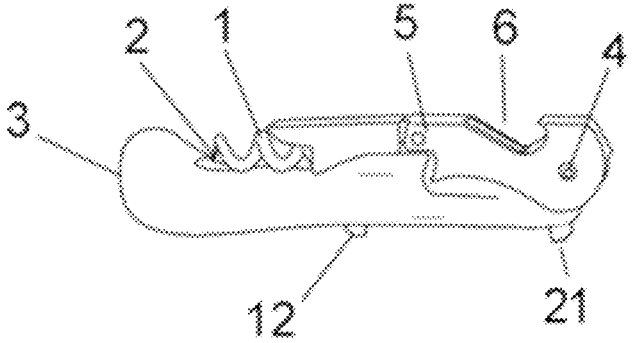
FIG. 2 shows a side elevation view of a corkscrew made according to the object of the present invention with the blade extracted.
Figure 3:
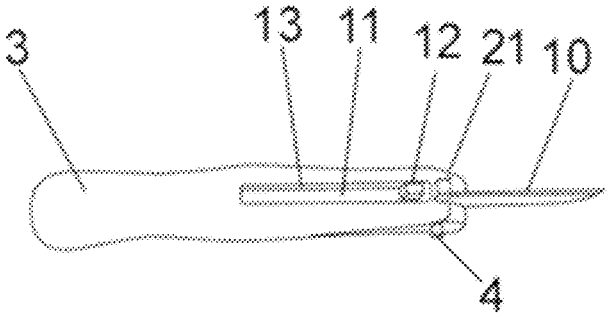
FIG. 3 shows a plan view of the assembly according to FIG. 2.

As is also conventional, the handle 3 attaches in an articulated manner at one of its ends and by means of a pin 4 to an also grooved support arm 5 (i.e. having a U-shaped cross-section) which tends to be provided with a recess (6) functioning as a capsule remover as especially shown in FIGS. 1 and 2, said arm being able to be single or double as conventional.

According to the invention, a metal core 7 is provided having a U-shaped cross section within the handle 3 shaped to the geometry of the handle and having a projection 8 on which the helix 1 is attached in an articulated manner through the corresponding pin 9.

Figure 4:
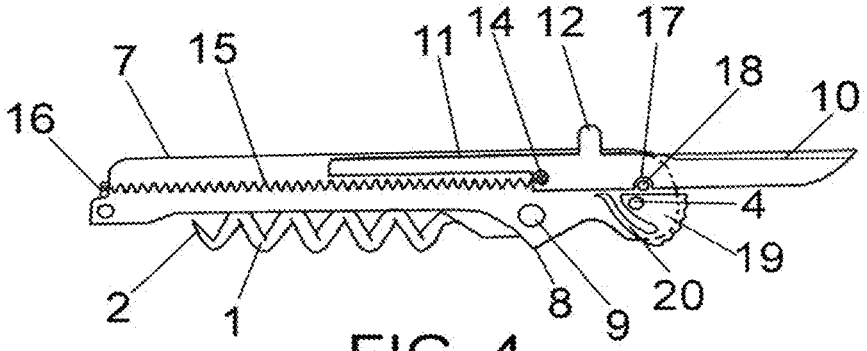
FIG. 4 shows a detailed side elevation view similar to that of FIG. 2 but in which the corkscrew has been deprived of its handle as well as the collapsible arm so that essential details of the invention can be seen with greater clarity.

As can be observed in FIG. 4, a capsule cutting blade 10 is a longitudinally displaceable within the metal core 7 extending in a straight rear sector 11, acting as a guide having a lateral projection 12 protruding through a groove 13 located on the handle 3, so that said lateral projection 12 acts as an operating element for extracting the blade with the user's thumb, the lateral projection will have a groove 14 fixed to an end a spring 15 by simple pressure, the other end of said spring relates to the rear end of the metal core 7 through a rod 16, forcing retraction of the blade.

Blade 10 has been provided with a recess 17 intended for coupling on a locking pin 18 arranged opposing the cutting direction of the blade, when the blade is fully extended to stabilize blade 10 in an operating condition so that it cannot be decoupled, while in a non-operating condition it is easily removed by simply applying pressure in the opposite direction to the blade working direction.

For protecting the finger while sliding the blade 10, a nipple (21) can be provided to act as a detent at the end of the groove where the lateral projection of the blade 12 slides.

Optionally, the blade could be assisted by an automatic closing mechanism so that it is not necessary to operate the blade with the finger on it, rather a hinged part 19 has been provided on the pin 4 acting in an eccentric manner so that by rotating said part decoupling of the blade is achieved and thus, the automatic retraction thereof.

To prevent involuntary operation, part 19 incorporates an elastic arm 20 established on the corresponding support, making the part function as a cam always forcing the non-operating position (i.e., at the position in which it does not interfere with the blade 10).

Finally, it must be pointed out that in FIG. 4 conventional elements of this type of corkscrew, such as for example, the band that tends to stabilize the helix 1 in non-operating condition have not been depicted for simplicity so that the drawing is easier to understand.

The invention claimed is:

1. A corkscrew with a semi-automatic telescopic capsule cutter comprising:

a helix (1) which fits into a grooved handle (3) so that in an operating condition of the helix (1), it can remain partially engaged in the grooved portion of the handle (3), said handle (3) being attached in an articulated manner by one of its ends to a support arm (5); and a metal core (7) having a U-shaped cross section incorporated into the handle (3), a capsule cutting blade (10) capable of protruding towards the outside of the handle (3) and longitudinally slidable within said metal core (7), the blade extending at its rear in an elongated sector (11) functioning as a guide having a lateral projection (12) protruding towards the outside of the handle (3) through a longitudinal groove (13) along which it is slidable, said blade incorporating a single recess (17) suitable to receive therein and coupled to a locking pin (18) fixedly located in said metal core (7) when said blade is in an operating condition, said blade protrudes towards the outside of the handle (3) only when said lateral projection (12) is directly pushed to slide along said longitudinal groove (13), and said blade is retracted into said metal core (7) when a blunt side of said blade is pushed causing decoupling of said locking pin from said single recess.

2. The corkscrew with a semi-automatic telescopic capsule cutter of claim 1, wherein the capsule cutting blade (10) is coupled to an end opposite to an end where the blade exits the metal core by a spring (15).

3. The corkscrew with a semi-automatic telescopic capsule cutter of claim 1, wherein the blade is assisted by an automatic closing mechanism comprising a part (19) hinged on a pin (4) acting in an eccentric manner, the rotation of which pushes said blunt side of said blade causing the automatic decoupling of said locking pin from said single recess and retraction of the blade.

4. The corkscrew with a semi-automatic telescopic capsule cutter of claim 1, comprising a nipple (21) acting as a stop at the end of the groove where the lateral projection of the blade (12) slides.

5. The corkscrew with a semi-automatic telescopic capsule cutter of claim 3, wherein said part (19) comprises an elastic arm (20) biasing the part acting in an eccentric manner to a non-operating position in which it does not interfere with the movement of said blade (10).

* * * * *